United States Patent [19]

Bankel et al.

[11] Patent Number: 4,995,317

[45] Date of Patent: Feb. 26, 1991

[54] SAFE-AND-ARM DEVICE FOR THE FUZE OF A SPIN-STABILIZED PROJECTILE

[75] Inventors: Adolf Bankel, Uttenreuth; Hans Strauss, Reichenschwand; Stephan Kerk, Schnaittach, all of Fed. Rep. of Germany

[73] Assignee: Diehl GmbH & Co., Fed. Rep. of Germany

[21] Appl. No.: 408,140

[22] Filed: Sep. 15, 1989

[30] Foreign Application Priority Data

Sep. 20, 1988 [DE] Fed. Rep. of Germany ..... 3831863

[51] Int. Cl.[5] ..... F42C 15/26

[52] U.S. Cl. ..... 102/235; 102/245; 102/251

[58] Field of Search ..... 102/235, 236, 245, 251, 102/231, 237, 244, 254

[56] References Cited

U.S. PATENT DOCUMENTS

| | | | |
|---|---|---|---|
| 3,595,169 | 7/1971 | Ziemba | 102/235 |
| 3,608,494 | 9/1971 | Ziemba | 102/235 |
| 3,636,880 | 1/1972 | Aske | 102/235 |
| 4,440,085 | 4/1984 | Rossmann et al. | 102/235 |

FOREIGN PATENT DOCUMENTS

| | | |
|---|---|---|
| 0068534 | 5/1983 | European Pat. Off. . |
| 2009988 | 9/1970 | Fed. Rep. of Germany . |
| 2539750 | 10/1977 | Fed. Rep. of Germany . |

*Primary Examiner*—David H. Brown

[57] ABSTRACT

A safe-and-arm or securing device for the fuze of a spinning or spin-stabilized projectile which includes a fuze member and a supporting member in which a spherical rotor is rotatably supported and which has a radial groove formed therein. The rotor possesses a bore having a detonator inserted therein, and in a peripheral region incorporates a grooves which extends along a plane which is axially offset relative to the radial groove, and with a spreadably or expandable restraining medium being inserted into the groove. The restraining medium releases the rotor which is retained in its secured position only subsequent to the firing of the projectile through the securing element which is spreadable and axially displaceable under the effect of axial and spin forces and which allows the rotor, after its release, to be pivoted in conjunction with the detonator into the armed position.

2 Claims, 2 Drawing Sheets

SAFE-AND-ARM DEVICE FOR THE FUZE OF A SPIN-STABILIZED PROJECTILE

BACKGROUND OF THE INVENTION

1. Field of the Invention

The present invention relates to safe-and-arm or securing device for the fuze of a spinning or spin-stabilized projectile which includes a fuze member and a supporting member in which a spherical rotor is rotatably supported, and which has a radial groove formed therein. The rotor possesses a bore having a detonator inserted therein, and in a peripheral region incorporates a groove which extends along a plane which is axially offset relative to the radial groove, and with a spreadable or expandable restraining medium being inserted into the groove. The restraining medium releases the rotor which is retained in its secured position only subsequent to the firing of the projectile through the securing element which is spreadable and axially displaceable under the effect of axial and spin forces and which allows the rotor, after its release, to be pivoted in conjunction with the detonator into the armed position.

2. Discussion of the Prior Art

From the disclosure of German Laid-Open Patent Appln. No. 20 09 988 there is disclosed a rotor securing or safe-and-arm device for the fuze of a spin-stabilized projectile. For effectuating the arming thereof it is necessary to provide for a firing acceleration as well as for the spin. The forces which result therefrom are exerted against a U-shaped expandable restraining ring. The restraining ring is seated in an annular or ring-shaped recess in the rotor. The sliding plane for the restraining ring is of a castellated configuration in the direction extending towards the rotor center. As a consequence thereof, the restraining ring is adapted to assume a forward position which is offset relative to a radial groove facing towards a housing.

Malfunctions can be readily encountered as a result of the non-uniform or uneven weight distribution of the U-shaped restraining ring. The firing acceleration and the spin can tilt the restraining ring in the radial groove facing the housing to such an extent during the rearward and opening displacement, that the arms will hinder the rotor from assuming the spin which is necessary for the functioning.

Furthermore, during rough handling of the projectile, as a result of an unintentional impact the restraining ring can clamp or jam in its rearward position and arrest the rotor in the secured or safe position. In both instances there are then encountered highly-explosive duds subsequent to firing.

From the disclosure of German Patent No. 25 39 750 it has become known, for a fuze of a spin-stabilized projectile, to provide a clamp-like securing element as the safe-and-arm or securing device for a rotor, and which is constituted of two radially curved arms which are interconnected through a curvilinear web or connector. The curvilinear or arched connector allows for a continual and uniform deflection of the two arms at a specified projectile spin. The action of the safe-and-arm device is only directed towards dependence upon the projectile spin. There is no provision of any arming criteria for the firing impulse.

SUMMARY OF THE INVENTION

Accordingly, it is an object of the present invention to provide, for the fuze of a spin-stabilized projectile, a rotor securing or safe-and-arm device which is constituted from only a few components which will dependably function upon the firing of the spin-stabilized projectile, in which the rotor is released and which, even after rough handling, will facilitate the resecuring of the rotor.

The foregoing object is achieved through the intermediary of a safe-and-arm device, as described in further detail hereinabove, in that in the secured position of the rotor, the restraining ring contacts against an end surface of an annular groove through the intermediary of a spring element which is positioned on a side of a housing for the fuze, wherein the restraining ring which is of a rectangular cross-section, possesses, in plan view thereof, a plurality of circumferentially spaced generally wedge-shaped grooves with internal, uniformly-distributed rotor supporting tongues and support surfaces, and forming an outer ring structure which is provided with a slot and possesses a plurality of permanently deformable connectors each of the same cross-section, and in which the restraining ring is maintained, under the formation of an inner and an outer radial annular gap between the bottom of the annular groove and the fuze housing.

Of importance to the invention is the presence of the restraining ring which contacts against the rotor in the absence of any radial prestressing the easy installation of the restraining ring on the rotor, and the axially freely movable restraining ring in the available space of the fuze housing due to the provided spring element.

The restraining ring possesses a narrow gap with regard to the applicable contact surfaces in both the centripetal and the centrifugal directions. Consequently, this will avoid material fatigues such as are encountered, for example, in the restraining rings pursuant to the current state-of-the-technology. Consequently, malfunctions will not be encountered in that regard.

The restraining ring, which is axially freely movable opposite a spring force, allows for the resecuring of the rotor, for example, under free-falling, dropping or bombing tests or under impact forces encountered during the handling of a projectile.

During the acceleration of the projectile in the weapon barrel, as a result of the invention there is provided the necessary operational safety with regard to releasing criteria, namely a first securing action during the projectile acceleration, and a second securing action upon the assumption of the spin.

The almost closed restraining ring supports the rotor in a radial direction against the fuze housing. In the presence of lateral or sideways-acting shock loads, the forces from the mass of the rotor are deflected from the restraining ring into the fuze housing. Disadvantageous deformations of the restraining ring cannot occur due to its relatively high moment of resistance. However, such deformations cannot be avoided in the U-shaped restraining ring pursuant to German OS No. 20 09 998 because of its essentially lower moments of resistance in the longitudinal direction thereof. A deformation of that kind in the known restraining ring can lead to the condition that the rotor will not be released or armed, notwithstanding the existing releasing criteria.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
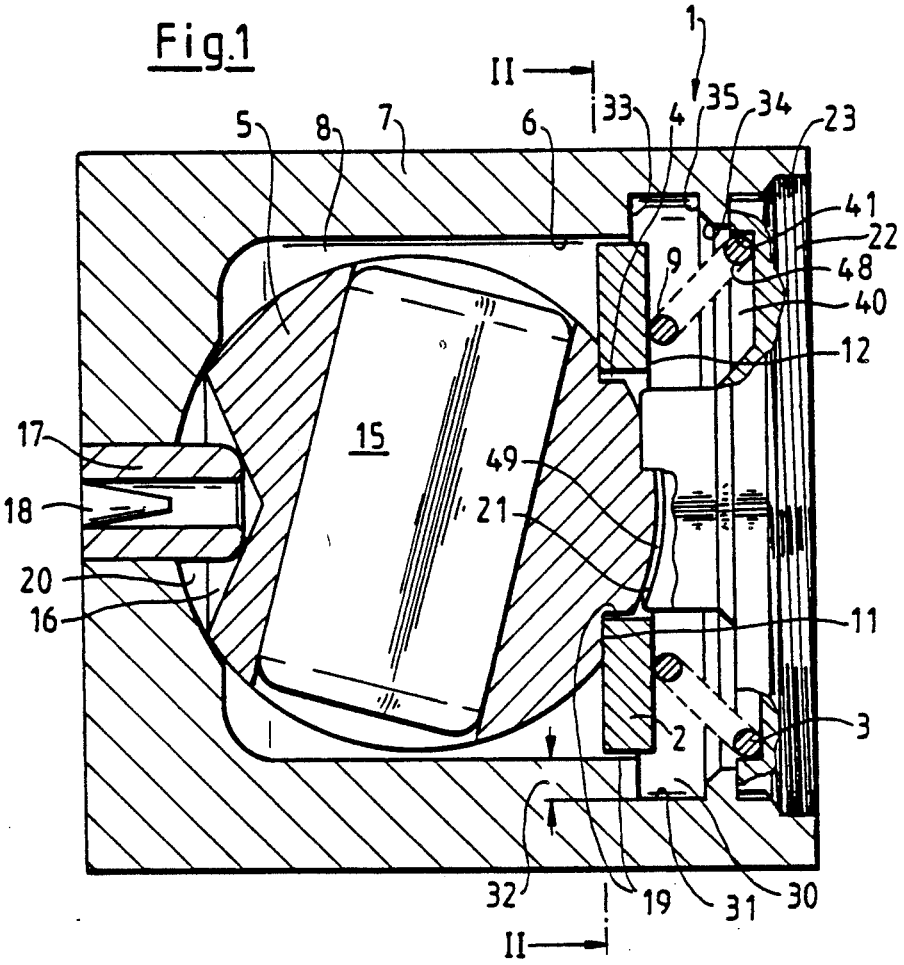
FIG. 1 illustrates a cross-sectional view through a fuze.

A securing or safe-and-arm device 1 contemplates that a restraining ring, on the one hand, is centered in an annular groove 4 in a rotor 5 through the effects of a conical compression spring 3 and, on the other hand, centered in radial directions through the annular groove 4 and a wall 6 of a fuze housing 7 across annular gaps 8.

The annular groove 4 possesses a bottom 10 and one end or side surface 11.

As is known in the art, the rotor 5 possesses a detonator 15 and a positioning cone 16 for an axially movable securing sleeve 17. The fuze housing 7 supports the securing sleeve 17 and a firing pin 18. Furthermore, the fuze housing 7 supports the already described rotor 5 through the intermediary of a spherical cutout or recess 20. As an opposite abutment support, there is provided a corresponding spherical recess in a bearing housing 22 for a charge. These cutouts or recesses 20, 21 form a sliding bearing or support for the rotor. Hereby, the compression spring 3 fixes the rotor 5 in position within the recess 20 through the intermediary of the restraining ring 2. A further auxiliary bearing is not provided in a recess 8 of the fuze housing 7.

Figure 2:
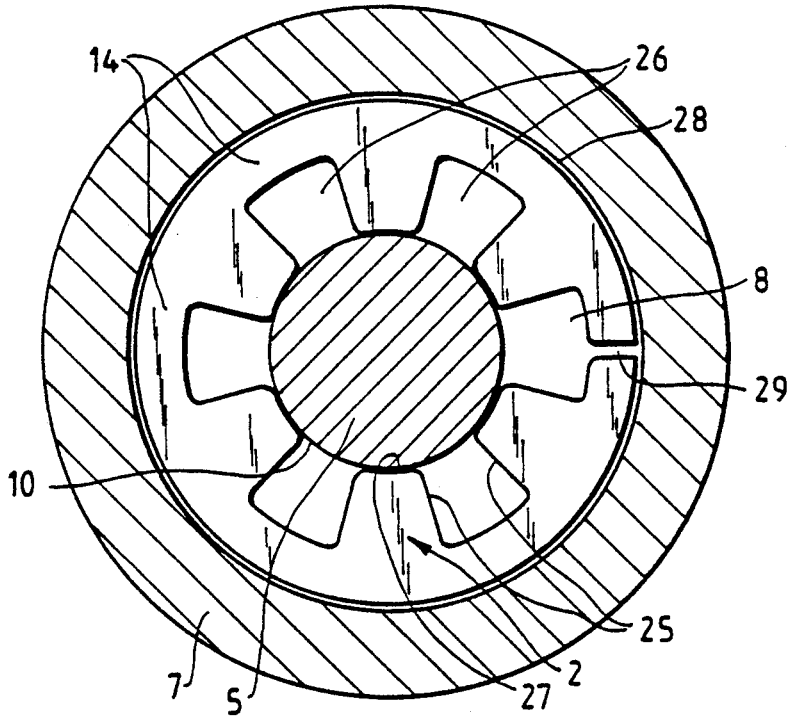
FIG. 2 illustrates a sectional view taken along line II—II in FIG. 1.
Figure 5:
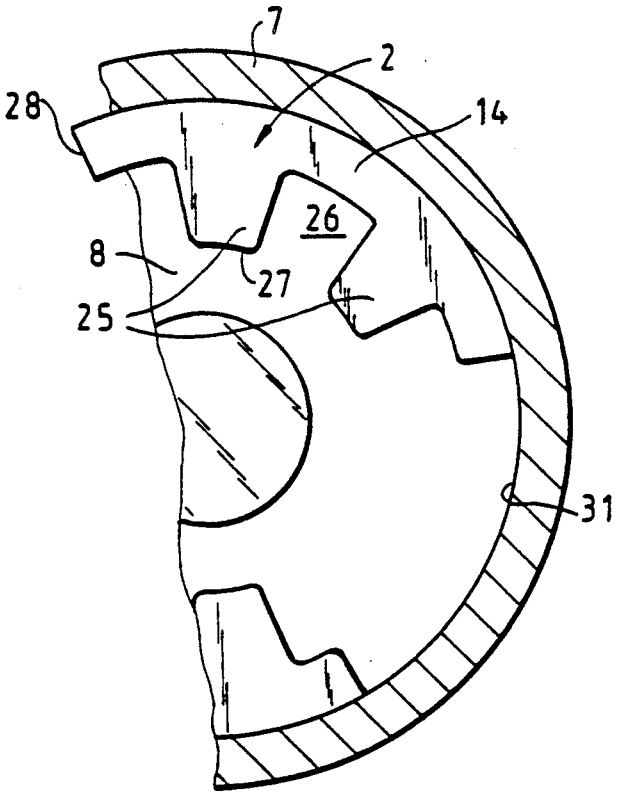
FIG. 5 illustrates a sectional view taken along line V—V in FIG. 4.

The restraining ring 2, pursuant to FIGS. 2 and 5, is provided with wedge-shaped grooves, as a result of which there are present inner support tongues 25 with interposed arranged cutouts 26. The support tongues 25 possess curved supporting surfaces 27 in conformance with the annular groove 4. A ring 28 is formed by the connectors and radially outer ends of the support tongues 25, whereby the ring 28 is split or separated by means of a slot 29.

The fuze housing 7 possesses a radial groove 30 whose bottom 31 is located deeper by the amount of the distance 32 than the wall 6 of the fuze housing. The two end or side surfaces 33, 35 are located spread so far apart such that the restraining ring 2 can be received with an adequate amount of axial play. An inclined surface 34 serves, as required, when an adjusting aid for the expanding restraining ring 2.

On the housing 22 for the charge there is provided a recess cutout 40 with an edge 41 extending about the circumference thereof enabling the receipt of the bottom 48 of the compression spring 3. Furthermore, the housing 22 for the charge is equipped with a booster charge (not shown).

The compression spring 3 has its head end portion 9 contacting against the surface 12 of the restraining ring 2. On the other end, the bottom end 48 of the compression spring 3 is supported by the housing 22 for the charge. The housing 22 is joined with the fuze housing 7 through a screw thread connection 23.

Figure 3:
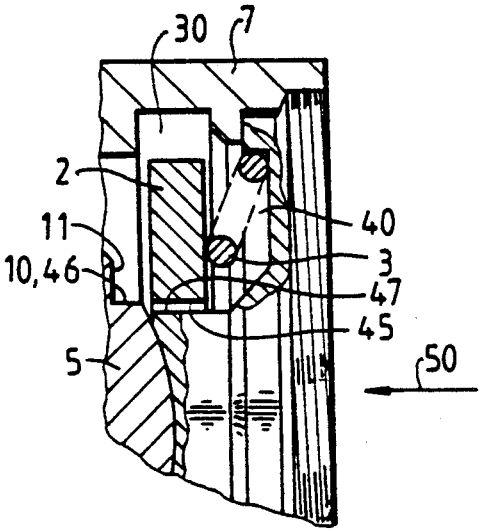
FIG. 3 illustrates the fuze of FIG. 1 upon the firing of a projectile.

The function of the inventive device is now described as follows:

The securing or safe-and-arm device 1 of a spin-actuated fuze (not shown) reacts to the firing acceleration, which is effective in the direction of arrow 50, through an axial thrust or displacement of the restraining ring 2 against the force of the compression spring 3, pursuant to FIG. 3. The restraining ring 2 is in its most extreme axially displaced position, inasmuch as the compression spring 3 can no longer be pressed together. In this position, the restraining ring 2 is in alignment with the radial groove 30. The restraining ring 2 can expand into the radial groove 30 in conformance with FIG. 4; subsequent to the assumption of the spin of a projectile within the weapon barrel.

The restraining ring 2 is constituted from a suitable beryllium-bronze alloy. This material selection allows the restraining ring 2, due to the centrifugal forces which mainly act on the supporting tongues 25, to completely contact against the bottom 31 of the radial groove 30. Thereby, the connectors 14 on the ring structure 28 which are located intermediate the support tongues 25 are plastically deformed; in essence, permanently deformed.

Figure 4:
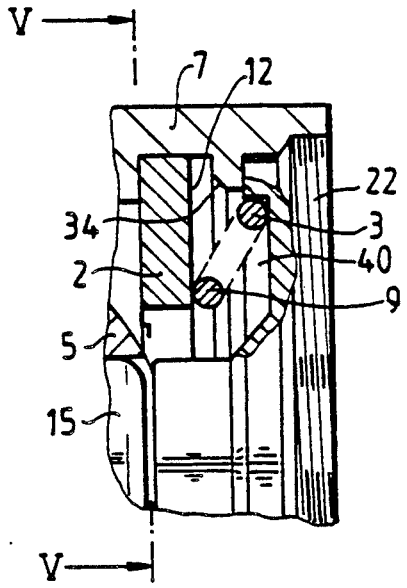
FIG. 4 illustrates the fuze pursuant to FIGS. 1 and 3 under the assumption of spin.

The rotor 5 which is a released from the restraining ring 2 orients itself into the position which is ascertainable from FIG. 4, because of the location of its center of gravity, as a consequence of which the securing sleeve 17 is pushed back by the positioning cone 16. The rotor 5 is then arrested in this armed position, as is ascertainable from this drawing figure, through suitable means (not shown). After the completed acceleration phase of the projectile, the compression spring 3 locates the restraining ring 2 against the end surface 33.

In the presence of a triggering criterium, the firing pin 18 will then strike, in a manner known per se, against the detonator 15. The ignition energy of the latter then triggers a transmitting charge. During a drop test or during rough handling, when there is exerted an impact against the safe-and-arm device 1 in conformance with the direction of arrow 50 as shown in FIG. 3, the restraining ring 2 will then move away from the rotor 5, pursuant to FIG. 3 and; however, subsequent to the impact will again resume its position on the rotor 5, as is ascertainable from FIG. 1. A possible axial offset of the bore diameter 45 relative to the diameter 46 of the annular groove 4 is avoided due to the almost identically-sized trunnion or bearing diameter 47 of the housing 22 for the charge.

The securing sleeve 17 allows for the rotor 5 to remain in the secured position pursuant to FIG. 1 during the phase in which the restraining ring 2 is lifted away from the rotor 5.

When a spin is exerted on a projectile during acceleration in a weapon barrel, and which does not reach the prescribed magnitude; for example, for a weapon barrel which is almost worn out from firing, then after the projectile exits from the weapon barrel there is again provided the presence of a secured rotor 5. The centrifugal forces which are exerted on the restraining ring 2 have not reached the magnitude for plastically deforming the connectors 14, as can be seen from FIG. 5, so that the restraining ring 2 has maintained its unchanged size, as shown in FIGS. 1 and 2.

Also of advantage is the resilient support of the rotor through intermediary of the compression spring 3. This compression spring 3 causes the formation of a gap 49, in that the rotor 5 is pressed into the recess 20 in the fuze housing 7. Upon the encounting of shock loads, due to the presence of the compression spring 3 and the gap 49, there is thus imparted to the rotor 5 the possibility of a spring-dampened positional displacement within the recess 8. Thereby, the triggering threshold for the detonator 15 when subjected to shock loads is substantially lower than for detonators pursuant to the state-of-the-technology.

Other suitable materials for the restraining ring 2 are aluminum or steel. The required material properties are a high resistance to fracture and a high degree of ductility or tensile strength.

What is claimed is:

1. A safe-and-arm device for a fuze for a spin-stabilized projectile; comprising a supporting housing for said fuze; a spherical rotor being rotatably supported within the supporting housing; a radially groove formed in said supporting housing, said rotor having a bore; a detonator inserted in said bore; an annular groove in a peripheral region of said rotor extending in a pane axially offset relative to said radial groove, a spreadable restraining means inserted in said rotor groove for arming the rotor which is retained in a secured position only after firing of the projectile through the spreadable restraining means which are axially displace and spread apart only subsequent to firing of the projectile responsive to axial and spin fores, and said spreading facilitating pivoting of the rotor with the detonator into the armed position after release thereof, said restraining means comprising a restraining ring; spring means located in said housing for said fuze so as to cause said restraining ring to contact an end surface of the annular groove in said rotor in the secured position of said rotor, said restraining ring having a plurality of substantially wedge-shaped grooves with radially inwardly extending supporting tongues and supporting surfaces distributed about the circumference thereof, and including an outer ring portion having a slot therethrough and forming a plurality of permanently deformable connectors intermediate said tongues each of similar cross-section, and said restraining ring being maintained between the bottom of the annular groove and the fuze housing under the formation of an inner and an outer annular gap.

2. Safe-and-arm device as claimed in claim 1, wherein said spring means comprises a conical compression spring having a bottom contacting an edge of a recess in said housing, and having a head end portion contacting said restraining ring so as to be freely movable in radial directions.

* * * * *